US008297154B2

(12) United States Patent
Chen

(10) Patent No.: US 8,297,154 B2
(45) Date of Patent: Oct. 30, 2012

(54) COMBINATION WRENCH WITH GREATER STRENGTH AND TORQUE

(75) Inventor: Timmy Chen, Taichung (TW)

(73) Assignee: Plus Craft Industrial Co., Ltd., Taichung (TW)

( * ) Notice: Subject to any disclaimer, the term of this patent is extended or adjusted under 35 U.S.C. 154(b) by 237 days.

(21) Appl. No.: 12/895,926

(22) Filed: Oct. 1, 2010

(65) Prior Publication Data

US 2012/0079920 A1 Apr. 5, 2012

(51) Int. Cl.
*B25B 23/16* (2006.01)
*B25G 1/10* (2006.01)

(52) U.S. Cl. ..... 81/177.1; 81/489

(58) Field of Classification Search ..... 81/177.1, 81/489

See application file for complete search history.

(56) References Cited

U.S. PATENT DOCUMENTS 1,424,676 A * 8/1922 Parsons ..... 81/125.1
D445,014 S * 7/2001 Douglas et al. ..... D8/107
D481,613 S * 11/2003 Macor ..... D8/107
6,655,239 B1 * 12/2003 Macor ..... 81/125.1
D494,833 S * 8/2004 Macor ..... D8/107
6,792,833 B2 * 9/2004 Macor ..... 81/125.1
6,895,837 B2 * 5/2005 Hsien ..... 81/125.1
D506,371 S * 6/2005 Hsien ..... D8/27
7,017,455 B2 * 3/2006 Hsien ..... 81/177.1
D520,824 S * 5/2006 Hsien ..... D8/28
7,047,845 B2 * 5/2006 Macor ..... 81/177.1
D562,655 S * 2/2008 Chen ..... D8/28
D631,311 S * 1/2011 Yang ..... D8/28
2005/0199107 A1 * 9/2005 Hsien ..... 81/177.1
2006/0021477 A1 * 2/2006 Hsien ..... 81/177.8

* cited by examiner

*Primary Examiner* — David B Thomas

(74) *Attorney, Agent, or Firm* — Alan Kamrath; Kamrath IP Lawfirm, PA

(57) ABSTRACT

A combination wrench includes a shank, a first driving member mounted on a first end of the shank, and a second driving member mounted on a second end of the shank. The shank has different cross-sectional profiles and areas from the first driving member to the second driving member so that the shank has different thickness from the first driving member to the second driving member so as to correspond to different forces. Thus, the mediate portion of the shank has a uniform thickness and has greater strength and torque so as to withstand a larger force so that when a stress is concentrated on the mediate portion of the shank, the mediate portion of the shank can tolerate the stress, thereby preventing the shank from being deformed or broken due to an excessive force.

9 Claims, 3 Drawing Sheets

COMBINATION WRENCH WITH GREATER STRENGTH AND TORQUE

BACKGROUND OF THE INVENTION

1. Field of the Invention

The present invention relates to a hand tool and, more particularly, to a combination wrench.

2. Description of the Related Art

A conventional combination wrench 1 in accordance with the prior art shown in FIGS. 1-4 comprises a shank 13, a first driving member 11 mounted on a first end of the shank 13, and a second driving member 12 mounted on a second end of the shank 13. The first driving member 11 is an open-ended spanner, and the second driving member 12 is a box-shaped spanner. The first driving member 11 and the second driving member 12 are disposed at the same plane. In operation, when the first driving member 11 or the second driving member 12 is used to operate a workpiece, such as a bolt, nut and the like, the reaction force is concentrated on the mediate portion of the shank 13. However, the shank 13 has a constant cross-sectional profile with a constant thickness as shown in FIGS. 2-4, so that when the reaction force is concentrated on the mediate portion of the shank 13, the mediate portion of the shank 13 easily produces a stress concentration, thereby distorting or breaking the shank 13 due to an excessive force.

BRIEF SUMMARY OF THE INVENTION

In accordance with the present invention, there is provided a combination wrench, comprising a shank, a first driving member mounted on a first end of the shank, and a second driving member mounted on a second end of the shank. The shank has different cross-sectional profiles and areas from the first driving member to the second driving member so that the shank has different thickness from the first driving member to the second driving member.

The first driving member has an upper side, a lower side, a rightward side and a leftward side. The second driving member has an upper side, a lower side, a rightward side and a leftward side. The shank has an upper side extending from the upper side of the first driving member to the upper side of the second driving member. The shank has a lower side extending from the lower side of the first driving member to the lower side of the second driving member. The shank has a rightward side extending from the rightward side of the first driving member to the rightward side of the second driving member. The shank has a leftward side extending from the leftward side of the first driving member to the leftward side of the second driving member. The distance between the upper side of the shank and the lower side of the shank is decreased gradually from the first driving member to the second driving member, and the distance between the rightward side of the shank and the leftward side of the shank is increased gradually from the first driving member to the second driving member.

Preferably, the shank has a diamond cross-sectional profile so that the shank has greater strength and torque so as to withstand a larger force.

The first driving member and the second driving member are disposed at two different planes. Preferably, the first driving member is perpendicular to the second driving member.

The first driving member is preferably an open-ended spanner. The second driving member is preferably a box-shaped spanner.

The distance between the upper side and the lower side of the shank is greater than that between the rightward side and the leftward side of the shank so that the first end of the shank near the first driving member has a height greater than a width of the shank.

The distance between the upper side and the lower side of the shank is equal to that between the rightward side and the leftward side of the shank so that a mediate portion of the shank has a height equal to a width of the shank. Thus, the mediate portion of the shank has a uniform thickness and will not produce a stress concentration so that the mediate portion of the shank has greater strength and torque to withstand a larger force, thereby preventing the shank from being deformed or broken due to an excessive force.

The distance between the upper side and the lower side of the shank is smaller than that between the rightward side and the leftward side of the shank so that the second end of the shank near the second driving member has a height smaller than a width of the shank.

The primary objective of the present invention is to provide a combination wrench with greater strength and torque.

According to the primary advantage of the present invention, the shank has different cross-sectional profiles and areas from the first driving member to the second driving member so that the shank has different thickness from the first driving member to the second driving member so as to correspond to different forces.

According to another advantage of the present invention, the mediate portion of the shank has a uniform thickness and has greater strength and torque so as to withstand a larger force so that when a stress is concentrated on the mediate portion of the shank, the mediate portion of the shank can tolerate the stress, thereby preventing the shank from being deformed or broken due to an excessive force.

According to a further advantage of the present invention, the shank has a diamond cross-sectional profile so that the shank near the first driving member and the second driving member has greater strength and torque so as to withstand a larger force.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
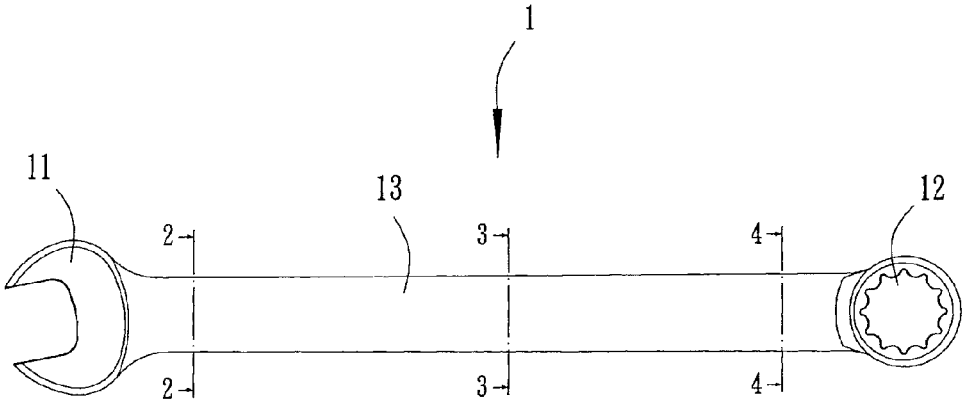
FIG.1 PRIOR ART
FIG. 1 is a top view of a conventional combination wrench in accordance with the prior art.
Figure 2:
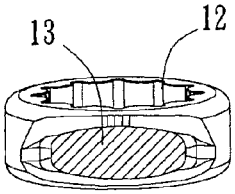
FIG.2 PRIOR ART
FIG. 2 is a cross-sectional view of the conventional combination wrench taken along line 2-2 as shown in FIG. 1.
Figure 3:
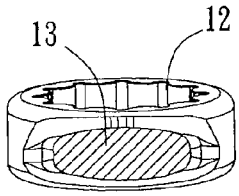
FIG.3 PRIOR ART
FIG. 3 is a cross-sectional view of the conventional combination wrench taken along line 3-3 as shown in FIG. 1.
Figure 4:
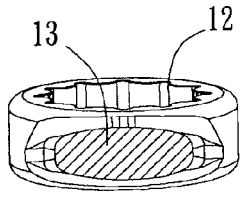
FIG.4 PRIOR ART
FIG. 4 is a cross-sectional view of the conventional combination wrench taken along line 4-4 as shown in FIG. 1.
Figure 5:
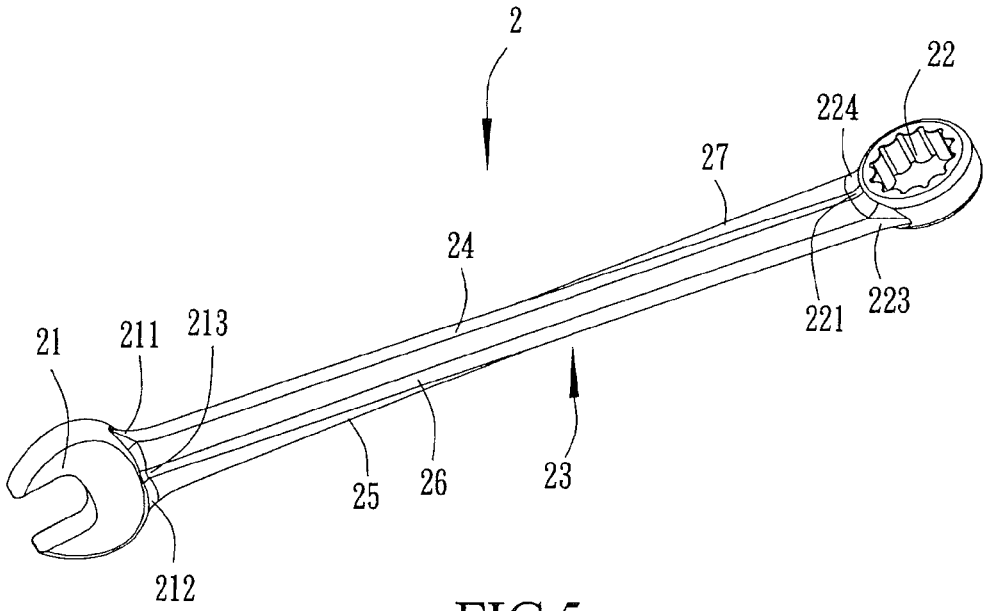
FIG. 5 is a perspective view of a combination wrench in accordance with the preferred embodiment of the present invention.
Figure 6:
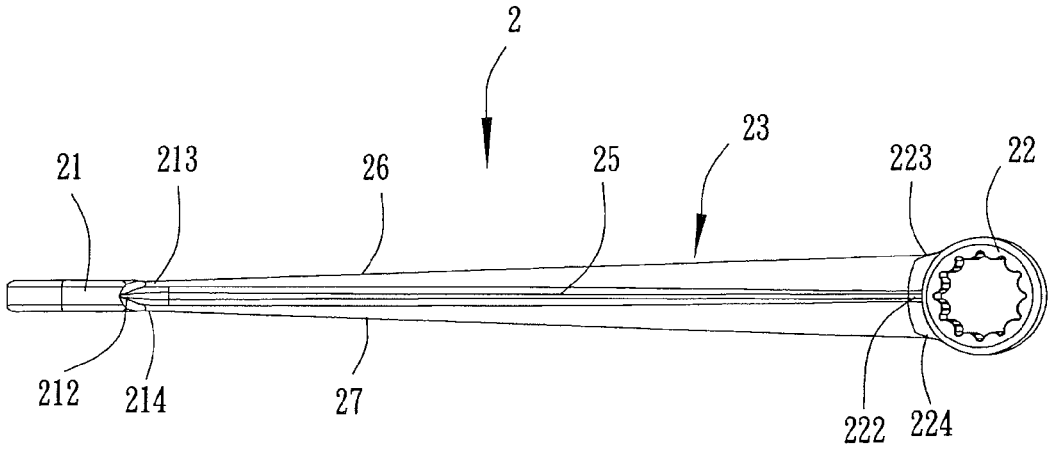
FIG. 6 is a bottom view of the combination wrench as shown in FIG. 5.

Referring to FIGS. 5-10, a combination wrench 2 in accordance with the preferred embodiment of the present invention comprises a shank 23, a first driving member 21 mounted on a first end of the shank 23, and a second driving member 22 mounted on a second end of the shank 23.

The first driving member 21 is preferably an open-ended spanner. The second driving member 22 is preferably a box-shaped spanner. The first driving member 21 and the second driving member 22 are disposed at two different planes. Preferably, the first driving member 21 is perpendicular to the second driving member 22.

The first driving member 21 has an upper side 211, a lower side 212, a rightward side 213 and a leftward side 214. The second driving member 22 has an upper side 221, a lower side 222, a rightward side 223 and a leftward side 224.

The shank 23 has an upper side 24 extending from the upper side 211 of the first driving member 21 to the upper side 221 of the second driving member 22. The shank 23 has a lower side 25 extending from the lower side 212 of the first driving member 21 to the lower side 222 of the second driving member 22. The shank 23 has a rightward side 26 extending from the rightward side 213 of the first driving member 21 to the rightward side 223 of the second driving member 22. The shank 23 has a leftward side 27 extending from the leftward side 214 of the first driving member 21 to the leftward side 224 of the second driving member 22.

As shown in FIGS. 7-10, the distance between the upper side 24 of the shank 23 and the lower side 25 of the shank 23 is decreased gradually from the first driving member 21 to the second driving member 22, and the distance between the rightward side 26 of the shank 23 and the leftward side 27 of the shank 23 is increased gradually from the first driving member 21 to the second driving member 22.

Figure 8:
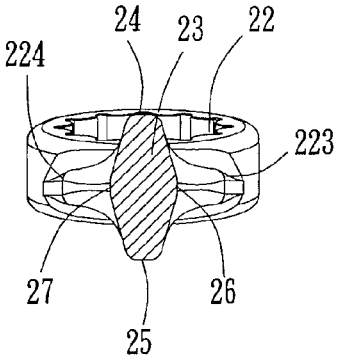
FIG. 8 is a side cross-sectional view of the combination wrench taken along line 8-8 as shown in FIG. 7.
Figure 9:
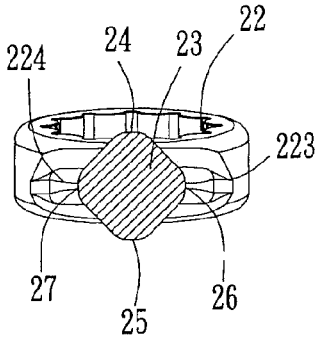
FIG. 9 is a side cross-sectional view of the combination wrench taken along line 9-9 as shown in FIG. 7.
Figure 10:
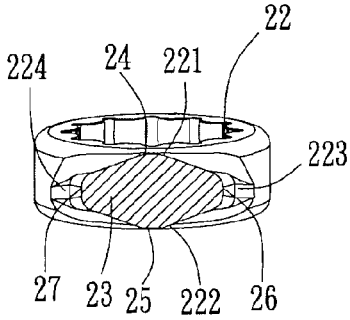
FIG. 10 is a side cross-sectional view of the combination wrench taken along line 10-10 as shown in FIG. 7.

In such a manner, the shank 23 has different cross-sectional profiles and areas from the first driving member 21 to the second driving member 22 as shown in FIGS. 8-10 so that the shank 23 has different thickness from the first driving member 21 to the second driving member 22. Preferably, the shank 23 has a diamond cross-sectional profile so that the shank 23 has greater strength and torque so as to withstand a larger force.

Figure 7:
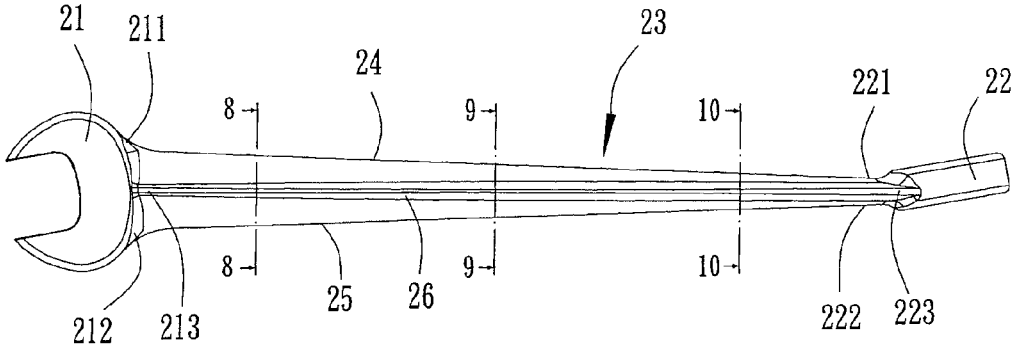
FIG. 7 is a front view of the combination wrench as shown in FIG. 5.

As shown in FIGS. 7 and 8, the distance between the upper side 24 and the lower side 25 of the shank 23 is greater than that between the rightward side 26 and the leftward side 27 of the shank 23 so that the first end of the shank 23 near the first driving member 21 has a height greater than a width of the shank 23.

As shown in FIGS. 7 and 9, the distance between the upper side 24 and the lower side 25 of the shank 23 is equal to that between the rightward side 26 and the leftward side 27 of the shank 23 so that a mediate portion of the shank 23 has a height equal to a width of the shank 23. Thus, the mediate portion of the shank 23 has a uniform thickness and will not produce a stress concentration so that the mediate portion of the shank 23 has greater strength and torque to withstand a larger force, thereby preventing the shank 23 from being deformed or broken due to an excessive force.

As shown in FIGS. 7 and 10, the distance between the upper side 24 and the lower side 25 of the shank 23 is smaller than that between the rightward side 26 and the leftward side 27 of the shank 23 so that the second end of the shank 23 near the second driving member 22 has a height smaller than a width of the shank 23.

Accordingly, the shank 23 has different cross-sectional profiles and areas from the first driving member 21 to the second driving member 22 so that the shank 23 has different thickness from the first driving member 21 to the second driving member 22 so as to correspond to different forces. In addition, the mediate portion of the shank 23 has a uniform thickness and has greater strength and torque so as to withstand a larger force so that when a stress is concentrated on the mediate portion of the shank 23, the mediate portion of the shank 23 can tolerate the stress, thereby preventing the shank 23 from being deformed or broken due to an excessive force. Further, the shank 23 has a diamond cross-sectional profile so that the shank 23 near the first driving member 21 and the second driving member 22 has greater strength and torque so as to withstand a larger force.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination wrench comprising:

a shank;

a first driving member mounted on a first end of the shank; and a second driving member mounted on a second end of the shank, wherein:

the shank has different cross-sectional profiles and areas from the first driving member to the second driving member;

the shank has different thickness from the first driving member to the second driving member;

the first driving member has an upper side, a lower side, a rightward side and a leftward side;

the second driving member has an upper side, a lower side, a rightward side and a leftward side;

the shank has an upper side extending from the upper side of the first driving member to the upper side of the second driving member;

the shank has a lower side extending from the lower side of the first driving member to the lower side of the second driving member;

the shank has a rightward side extending from the rightward side of the first driving member to the rightward side of the second driving member;

the shank has a leftward side extending from the leftward side of the first driving member to the leftward side of the second driving member;

the distance between the upper side of the shank and the lower side of the shank is decreased gradually from the first driving member to the second driving member; and the distance between the rightward side of the shank and the leftward side of the shank is increased gradually from the first driving member to the second driving member.

2. The combination wrench of claim 1, wherein the shank has a diamond cross-sectional profile.

3. The combination wrench of claim 1, wherein the first driving member and the second driving member are disposed at two different planes.

4. The combination wrench of claim 3, wherein the first driving member is perpendicular to the second driving member.

5. The combination wrench of claim 1, wherein the first driving member is an open-ended spanner.

6. The combination wrench of claim 1, wherein the second driving member is a box-shaped spanner.

7. The combination wrench of claim 1, wherein the distance between the upper side and the lower side of the shank is greater than that between the rightward side and the leftward side of the shank, wherein the first end of the shank near the first driving member has a height greater than a width of the shank.

8. The combination wrench of claim 1, wherein the distance between the upper side and the lower side of the shank is equal to that between the rightward side and the leftward side of the shank, wherein a mediate portion of the shank has a height equal to a width of the shank; and the mediate portion of the shank has a uniform thickness.

9. The combination wrench of claim 1, wherein the distance between the upper side and the lower side of the shank is smaller than that between the rightward side and the leftward side of the shank, wherein the second end of the shank near the second driving member has a height smaller than a width of the shank.

* * * * *